US007922015B2

(12) United States Patent
Bassetti

(10) Patent No.: US 7,922,015 B2
(45) Date of Patent: Apr. 12, 2011

(54) WINE-BARREL WINE RACK SYSTEM

(76) Inventor: Chet Bassetti, Reno, NV (US)

( * ) Notice: Subject to any disclaimer, the term of this patent is extended or adjusted under 35 U.S.C. 154(b) by 149 days.

(21) Appl. No.: 12/210,820

(22) Filed: Sep. 15, 2008

(65) Prior Publication Data

US 2009/0071920 A1 Mar. 19, 2009

Related U.S. Application Data

(60) Provisional application No. 60/993,577, filed on Sep. 13, 2007.

(51) Int. Cl.
*A47B 73/00* (2006.01)

(52) U.S. Cl. ..... 211/74; 211/194

(58) Field of Classification Search ..... 211/74, 211/76, 77, 70.01, 194; 312/135, 305, 311; 217/72, 73, 75
See application file for complete search history.

(56) References Cited

U.S. PATENT DOCUMENTS 2,182,003 A * 12/1939 Roark ..... 108/138
2,580,676 A * 1/1952 Gross ..... 211/75
2,781,072 A * 2/1957 Kouke ..... 206/315.6
3,429,450 A * 2/1969 Lambert ..... 211/60.1
4,274,216 A 6/1981 Boyd
4,460,221 A 7/1984 Dimino
4,506,796 A * 3/1985 Thompson ..... 211/59.4
4,700,849 A * 10/1987 Wagner ..... 211/41.2
5,188,243 A * 2/1993 Ruiz ..... 211/70.2
D348,182 S * 6/1994 Young ..... D7/702
D348,221 S 6/1994 Hirst et al.
5,403,079 A * 4/1995 Fetisoff ..... 312/204
7,398,889 B1 * 7/2008 McNulty ..... 211/77
7,506,771 B2 * 3/2009 Bianchini ..... 211/75
2004/0099622 A1 * 5/2004 Lee ..... 211/85

* cited by examiner

*Primary Examiner* — Korie Chan
(74) *Attorney, Agent, or Firm* — Holland & Hart LLP

(57) ABSTRACT

A storage system for wine bottles is provided that includes at least a portion of a wine barrel. A front head plate of the barrel is provided with multiple openings that are sized to receive the wine bottles to be stored. Support members of various designs are associated with each opening to extend lengthwise through the barrel interior to hold one or more wine bottles. The storage system may be provided in a variety of sizes that include full, half, and third-barrel sizes. A climate control system may be associated with embodiments of the storage system. The storage system may be provided with one barrel or a plurality of barrels arranged in various stacked configurations.

23 Claims, 17 Drawing Sheets

WINE-BARREL WINE RACK SYSTEM

CROSS-REFERENCE TO RELATED PATENT APPLICATIONS

The invention claims priority from U.S. Provisional Patent Application No. 60/993,577 entitled WINE-BARREL WINE RACK SYSTEM by Chet Bassetti, filed on Sep. 13, 2007, which Provisional Patent Application is hereby incorporated by reference in its entirety.

BACKGROUND

Wine-bottle storage systems have included various configurations of racks, shelves, and the like. Some systems, especially those intended for long-term wine storage, have included environmental controls to regulate temperature, for example. Some conventional wine-bottle storage systems have been configured solely for their functional aspects. These systems included, for example, traditional shelving and racks that could be used for storing a wide array of differently shaped items. These systems are easily adapted to particular storage environments and settings.

For many people, wines have possessed a certain romance about them that extended to the manner and settings in which wines have been made. This romance has been exploited in commercial aspects of the wine business, such as wholesale or retail wine sales, and in restaurants. This romance has also been exploited by individual wine consumers, especially those who purchase wine in sufficient quantity to create a personal supply requiring some kind of storage. In these and other settings, consumers and merchants have sought wine-bottle storage systems that could be configured to display the bottles in a manner that hearkens to or draws on the romance of wine.

Some previous approaches to design more evocative wine-bottle storage systems have involved the use of wine barrels or portions thereof. However, many of these approaches lacked authenticity. Other approaches provided limited storage capacities. Still other designs presented various difficulties in accessing individual bottles. Other barrel-based storage systems for bottles employed standard horizontal racks that did not take full advantage of the storage density within the barrels.

An example of a previous storage system that was based on a barrel is disclosed by U.S. Pat. No. 4,274,216. In particular, the design split the barrel in half, lengthwise. The two halves were then coupled with one another by hinges positioned on one side of the barrel. In this manner, the barrel could be opened and closed like a clam shell, whereby one half of the barrel served as a storage base and the other half functioned as a lid. A plurality of elongated dowels was positioned within the lower half of the barrel so that the dowels extended transversely with a long axis of the barrel. The dowels were positioned to be spaced laterally from one another, allowing a plurality of information cards to be supported by the dowels. However, this disclosure did not teach the storage of bottles within the barrel.

In another storage system, disclosed by U.S. Pat. No. 4,460,221, a barrel was configured to store various elements of a wine bar, such as glassware, bottles, and the like. In this design, a wine barrel was configured with racks in a lower half of the wine barrel for storing a small number of bottles. An upper half of the barrel was provided with brackets for supporting stemware. The upper half of the barrel was further designed to display a single, centrally located bottle. One or more doors were provided at one end of the barrel for accessing the contents of either or both the upper and lower half of the barrel. However, this design did not efficiently orient the racks so that a maximum number of bottles could be stored within the barrel. Moreover, environmental conditions were not considered within this design, making it less desirable for long-term storage of wine.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

Some embodiments of bottle racks may be formed from a used or newly constructed wine barrel. The structure of the barrel may include a plurality of staves and hoops that define the sides of the barrel and an open interior. The barrel may, in some embodiments, include a front head plate and/or a rear head plate. In various embodiments, the front head plate is provided with multiple openings that pass through the front head plate. The openings are sized to allow a wine bottle to be inserted and retrieved end-wise through the openings. In some embodiments, the openings are provided to be approximately 4 inches in diameter, which will accommodate passage of most 750-ML wine and champagne bottles. In some embodiments that use a 50-gallon capacity barrel, thirteen four-inch openings may be formed in the head plate. The openings may be any desired shape that permits the passage of bottles through the openings, such as round, oval, square, triangular or other polygonal shape.

In various embodiments, each opening has associated therewith, inside the barrel, one or more respective support members that are elongated and configured to support one or more bottles in approximate axial alignment with their respective openings. The support members may have any of various configurations including, but not limited to, parallel rods, shafts, or the like; cradles; tubes; elongated boxes; or other configurations capable of supporting one or more bottles in an end-to-end manner. In at least one embodiment, the support members are provided as a respective pair of rigid, parallel rods extending lengthwise from the front head plate to the opposing rear head plate. The rods are separated by a distance less than the diameter of the bottles to be supported by them.

Embodiments using a 50-gallon barrel are provided with approximate dimensions that allow each opening and its associated support member to support up to three 750-ML bottles end-to-end. Where the front end panel is provided with thirteen openings, a total of 39 bottles of 750-ML capacity can be stored in such an embodiment. Thus, the size (denoted as the capacity) of the barrel determines the number of wine bottles that can be accommodated in the barrel. Room dimensions are among various factors to consider when selecting barrel size. In some embodiments, a wine rack may be constructed using half of a barrel. In such an embodiment, a barrel is cut along an approximate midpoint of the barrel, through the bilge, along a line that is transverse with along axis of the barrel. Such embodiments, depending on the type of barrels used, will measure approximately 17" deep and may hold two wine bottles per support member where the bottles are allowed to protrude slightly from the front and rear head plates. In other embodiments, a wine rack may be provided using a third of a barrel by cutting one third of the barrel from the barrel's remainder along a line that is transverse with a long axis of the barrel. Depending on the type of barrel used, such embodiments may measure approximately 12" deep and will generally hold one wine bottle per support member. Both end thirds of the barrel and the middle third may be used to construct a wine rack. Due to the middle third occupying the bilge of the barrel, in many embodiments, wine racks made from the middle third may have open ends that measure approximately 24" in diameter, which will accommodate twenty one support members, as opposed to the thirteen support members generally available within a wine rack formed from an end third of the barrel.

Various embodiments of the wine rack system may include a single barrel or an arrangement of multiple barrels positioned next to one another. In such multiple barrel arrangements, the barrels may be arranged side-by-side or stacked relative to each other; the latter in a manner, for example, that is similar to the manner in which barrels are stacked in a winery or wine cave. In some embodiments, wooden barrel wedges may be placed between or beneath barrels. Other embodiments may use "barrel cradles" or racks to stack the barrels relative to one another.

In one method of forming a wine rack system, the openings may be cut in the rear and/or front head plate(s) while leaving the head plate(s) attached to the barrel. Mounting holes for the support members may also be formed in the head plates at the same time. Then, after forming the openings, the support members can be inserted through the openings and positioned for mounting to the head plates inside the barrel without having to remove the head plates. In some embodiments, the support members can be mounted to interior surfaces of the head plates using screws or other suitable mechanical fasteners that are inserted from outside the barrel. Alternatively, one or both head plates can be removed from the barrel to permit forming the openings and mounting holes in the head plates.

In some embodiments, each support member may be, at least partially, tube-shaped. In such embodiments, the support members may be made from any of various materials such as stiff paper or cardboard metal, wood, plastic, terra cotta, or the like. In other embodiments of the wine rack system, the support members are configured as cradles. Each cradle support member may include a pair of parallel rods and an intermediary portion that extends between the shafts in a bottle-conforming manner. In some embodiments, a sling may be formed from a pair of rigid, parallel rods and a sleeve that hangs between the rods that are mounted in a laterally spaced apart manner. The sleeve may be made of a rigid or flexible material.

In various embodiments, the support members may be attached to the front and rear head plates. In other embodiments, the support members may be attached to the front head plate and to a rear support plate that is vertically disposed within the rearward portion of the barrel. In some embodiments, the support members may be attached to an internal frame that is inserted into the barrel. In one embodiment, the internal frame may include a front support plate positioned within the barrel behind the front head plate, a rear support plate positioned within the barrel in front of the rear head plate, and the shafts that extend between the front and rear support plates. The internal frame may be aligned with the openings in the front head plate of the barrel using dowels of other locating structures, such as pins.

Various embodiments of the wine racks may incorporate the use of one or more environmental controls. In particular, the wine racks may include a cooling system, such as a "vapor phase" system that uses a compressor, evaporator, and condenser. In some embodiments, an evaporator may be positioned at the top of the interior of the barrel, between the top support members, to promote an efficient heat transfer within the barrel. The condenser may be placed outside the wine rack and, in some embodiments, concealed beneath the barrel. Other embodiments may position the condenser and compressor within the barrel. Adequate insulation for the cooling system may be afforded where the barrel is formed from ¾" wooden staves. It is contemplated, however, that additional layers of insulation could be provided to the interior walls of the barrel where desired. In various climate controlled embodiments, the rearward and forward ends of the support members may be covered to prevent heat gain in the stored bottles. In some embodiments, the rearward portions of the support members may be closed using a solid rear head plate. In other embodiments, the rearward and forward portions of the support members may be covered with one or more removable covers to allow for easy bottle access. In other embodiments, the individual covers can be made of a flexible material with a center hole (to allow the bottleneck to be exposed) and a series of one more radial "slits" in the flexible material to create "flaps" which will allow access to the bottles and then create a satisfactory closure to the end of the support member.

These and other aspects of the present system and method will be apparent after consideration of the Detailed Description and Figures herein. It is to be understood, however, that the scope of the invention shall be determined by the claims as issued and not by whether given subject matter addresses any or all issues noted in the Background or includes any features or aspects recited in this Summary.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show by way of illustration, specific exemplary embodiments. These embodiments are disclosed in sufficient detail to enable those skilled in the art to practice the technology. However, embodiments may be implemented in many different forms and should not be construed as being limited to the embodiments set forth herein. The following detailed description is, therefore, not to be taken in a limiting sense.

Figure 1:
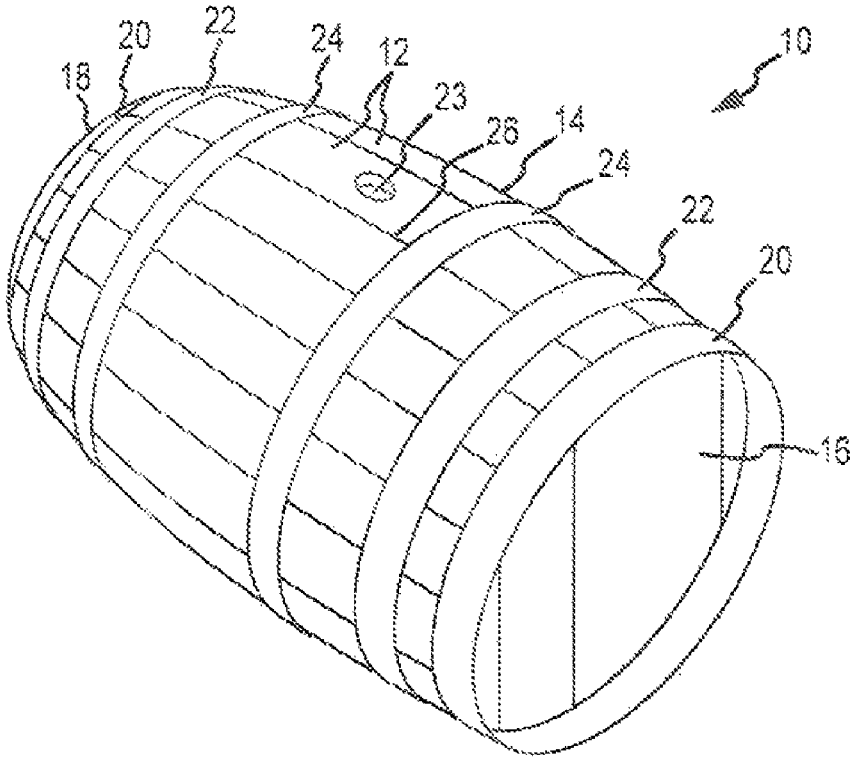
FIG. 1 is a perspective view of a barrel that may be used within various embodiments of the present wine rack system.

With reference to FIG. 1, a typical wine barrel 10 is typically defined by a generally annular sidewall that, in many cases is constructed from multiple wooden staves 12. Each stave 12 is shaped to be elongated, with a slightly arcuate geometry that peaks at an approximate midpoint of each stave 12. Side portions of each stave 12 are often planar and positioned at slight angles with respect to one another on opposite sides of each stave 12. In this manner, a plurality of staves 12 may be positioned closely adjacent one another so that each stave 12 is coupled with two other staves 12 at their respective sides. Together, the plurality of staves 12 form a hollow container having a roughly cylindrical shape with a bilge 14 at a point intermediate opposite ends 16 and 18. The ends 16 and 18 of the barrel are typically provided with planar circular shapes and are called "heads." The heads 16 and 18 are often times made from multiple lengths of wood.

The staves 12 are held in place under radial tension by circular hoops of various sizes, which may include head hoops 20, quarter hoops 22 (from smallest in diameter to largest), and bilge hoops 24. The hoops 20, 22, 24 keep the staves 12 pressed together longitudinally and radially, and thus tightly join along stave joints 26 extending the length of the barrel. Each hoop 20, 22, 24 is usually galvanized steel and is connected end-wise by rivets. The transverse circularity of the barrel 10 and the radially projecting bilge 14 enable the barrel to be rolled easily. The bilge 14 also allows the barrel to be spun and turned easily to control direction of roll. The tare weight of most wine barrels is 125-140 lbs. Access to the interior of a typical wine barrel is through a bung hole 28, which is normally fitted with a stopper (not shown). Although FIG. 1 depicts a typical arrangement of hoops 20, 22, 24, different wineries can specify the placement of the hoops in view of the manner in which the barrels are stacked on their particular barrel-storage racks.

Figure 2:
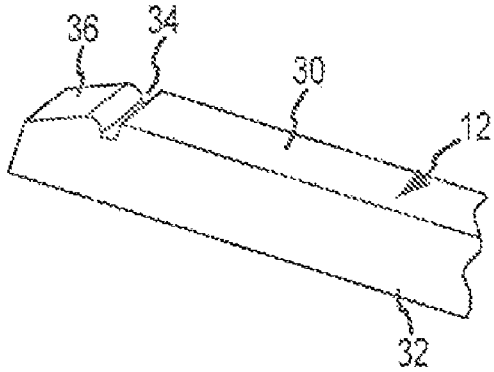
FIG. 2 depicts a partial isometric view of a barrel stave that may be used in the construction of the barrel depicted in FIG. 1.

With reference to FIG. 2, a conventional stave 12, is shaped to have an inside surface 30, outside surface 32, a croze 34, and a chime 36. The croze 34 and chime 36 appear on both ends of each stave 12. The crozes 34 of all the staves collectively form, on each end of the barrel, a respective circular channel that receives a peripheral edge of the respective head. The chimes 36 define a chamfered inner rim portion around each end of the barrel that reduces the probability of physical damage occurring to the heads during normal use and may make it easier to position the head plate within the croze 34.

Many commercial wine barrels are hand-made and fabricated from natural materials, such as oak. Accordingly, actual barrel dimensions can vary from one barrel to the next. The most common types of oak barrels for wine are the Bordeaux Barrel and the Burgundy Barrel. The head of the Bordeaux-style barrel is approximately 21.5 inches in diameter. The head of the Burgundy-style barrel is approximately 23 inches in diameter. A 59-gallon capacity is the most prevalent among commercially used wine barrels. However, some small wineries may use 30-gallon barrels. Other sizes such as 50-gallon are also used.

The wine rack 100 may be formed, at least in part, from a used or newly constructed wine barrel 102 that is situated in a substantially horizontal orientation. Use of an actual wine barrel may provide an authentic evocation of the romance of wine and wine-making. Also, authentic wine barrels can be readily stacked in traditional manners used in wineries, wine caves, and the like. However, it is contemplated that the barrel 102 could be newly constructed from a wide array of materials. In some examples, the barrel 102 could be formed from staves 104 formed from various different woods, metals, plastics and the like. In some embodiments, the barrel 102 could be constructed, in whole or in part, from recycled materials that could include various natural and inorganic materials alone or in combination with one another. Such materials may be provided in a particulate form and bonded with various materials such as resins, polymers, glues, epoxies, and the like. Similarly, the hoops 20, 22, 24 may be provided from a wide array of similar materials as those described with respect to the staves 104.

As described generally above, the barrel 102 will be provided with a generally annular sidewall that may be formed in some embodiments from a unitary construction and in other embodiments from a plurality of staves 104. Hoops 106 of various diameters may be included and may provide structural support to the barrel 102 or may be provided for aesthetic purposes. The barrel 102 may, in some embodiments, include a front head plate 108 and/or a rear head plate 110. In various embodiments, the front head plate 108 defines multiple openings 112 that pass through the front head plate 108. Desirably, the openings 112 are arranged to provide the largest number (or at least an efficient number) of openings of an appropriate diameter in the surface area of the head plate 108. More specifically, each opening 112 has a diameter sufficient to allow a wine bottle to be inserted end-wise into the opening and to allow retrieval of the wine bottle via the opening. By way of example, each opening 112 is 4 inches in diameter, which will accommodate passage of most 750-ML wine bottles. Larger diameter openings can accommodate larger bottles (e.g., magnums) as well as smaller bottles. In the depicted embodiment, the barrel 102 has a nominal 50-gallon capacity, and thirteen openings are defined in the head plate 108. In many embodiments, the openings 112 will be round. However, it is contemplated that the openings may also be provided in nearly any other desired shape. The rear head plate 110 in some embodiments can be configured as a solid, planar disk, similarly to a conventional head plate. In other embodiments, the rear head plate 110 may be configured similarly to the front head plate 108.

In various embodiments, each opening 112 has associated therewith, inside the barrel, one or more respective support members 114. In some embodiments, the support members 114 are elongated and configured to support multiple bottles end-to-end inside the barrel in approximate axial alignment with the respective opening 112. Thus, the barrel 102 may contain multiple support members 114 arranged front-to-rear and substantially parallel to each other inside the barrel. Depending upon the particular embodiment, the support member 114 can have any of various configurations including, but not limited to, parallel rods, shafts, or the like; cradles; tubes; elongated boxes; or other configurations capable of supporting multiple bottles in an end-to-end manner. In at least one embodiment, each support member 114 is provided as a respective pair of parallel rods 116 extending lengthwise from the front head plate 108 to the opposing rear head plate 110. The rods 116 may be made of any of various rigid materials such as, but not limited to, wood, metal, and plastic. The rods 116 of each pair are typically separated by a distance less than the diameter of the bottles to be supported by them.

In embodiments that use a 50-gallon barrel, each opening 112 and its associated support member 114 can support up to three 750-ML bottles end-to-end. The front head panel 108 can be provided with thirteen openings 112. Thus, a total of 39 bottles of 750-ML capacity can be stored in such an embodiment. Thus, the size (denoted as the capacity) of the barrel 102 determines the number of wine bottles that can be accommodated in the barrel 102. Room dimensions are among various factors to consider when selecting barrel size.

Various embodiments of the wine rack system may include a single barrel 102 or multiple barrels 102. Multiple barrels 102 can be arranged, e.g., side-by-side or stacked relative to each other, the latter in a manner, for example, that is similar to the manner in which barrels are stacked in a winery or wine cave, thereby enhancing the authenticity of the overall arrangement. Different wineries use different barrel-stacking methods, including use of wooden barrel wedges 118 between or beneath barrels, use of "barrel cradles" 120 (wood or metal) between or beneath barrels, or use of barrel racks (usually metal). Any of these arrangements, including stacking arrangements, allow the contents of each barrel to be individually accessed without disrupting the other barrels or their contents.

Figure 3A:
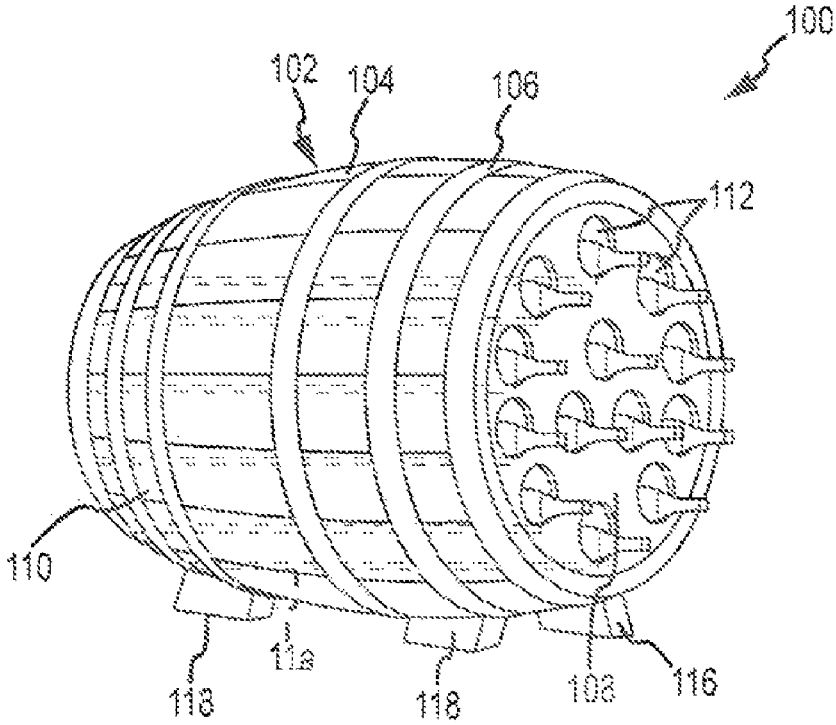
FIG. 3A depicts a perspective view of one embodiment of the wine rack system.
Figure 3B:
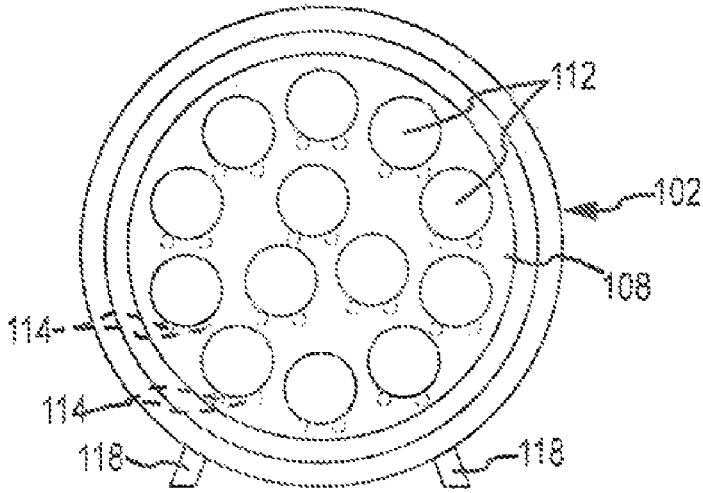
FIG. 3B depicts a front elevation view of the wine rack system depicted in FIG. 3A.
Figure 3C:
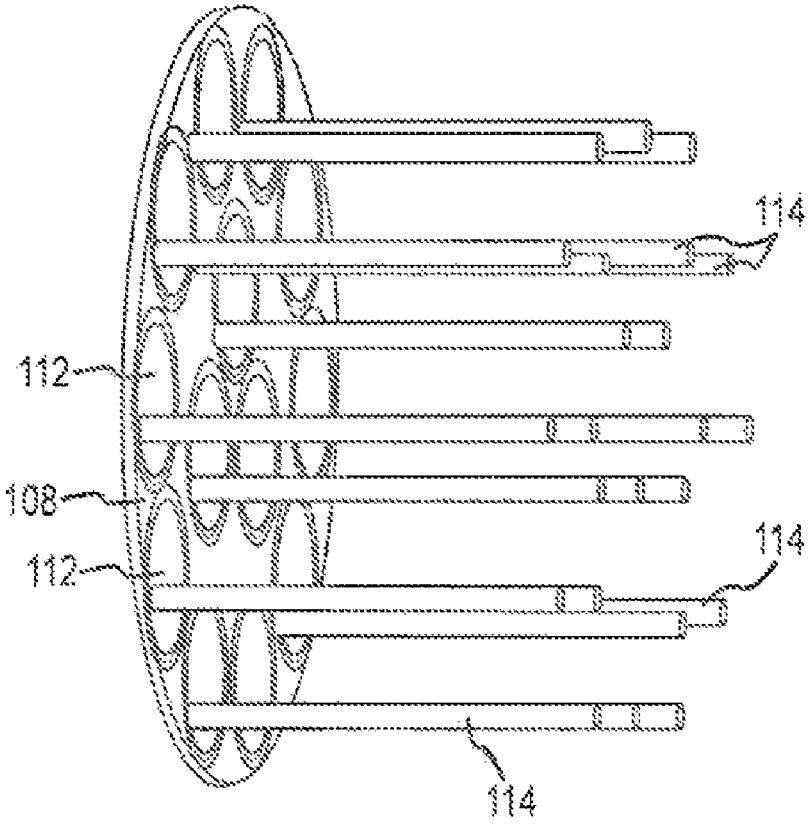
FIG. 3C depicts one embodiment of a plurality of support members that may be used within the various embodiments of the wine rack system.
Figure 3D:
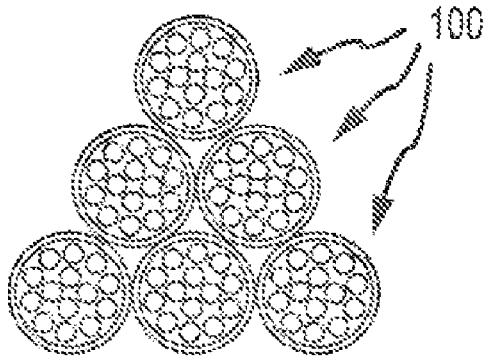
FIG. 3D depicts a front elevation view of one embodiment of the wine rack system that incorporates the use of a plurality of barrels.

With reference to FIG. 3A, a single barrel embodiment may position the barrel horizontally on the floor, stabilized by wedges 118 or the like. This arrangement may limit barrel movement from side-to-side or tipping front-to-back. Barrel wedges 118 may also be used to stack multiple barrels in pyramid arrangements. With reference to FIG. 3D, six barrels 102 can be stacked with three barrels on a bottom row, two barrels on a middle row an done barrel on a top row to provide storage for as many as 234 750-ML bottles. The wedges 118, and the fact that lower barrels form depressions in which upper barrels fit, resist side-to-side movement of individual barrels. The wedges 118 may be shaped to have a curved surface that engages the curved outer surface of a barrel in a manner that resists forward and backward motion or rocking of individual barrels 102. In some embodiments, the curved surface of the wedges 118 may be generally parabolic in shape. It is contemplated that some wedges may have multiple curved surfaces where a single wedge 118 will engage more than one barrel 102 simultaneously. Some such embodiments may provide one curved surface to engage each barrel 102 to be engaged by the wedge 118. Various embodiments use multiple wedges 118 near the front and back portions of the barrels 102 to promote stability.

Figure 7:
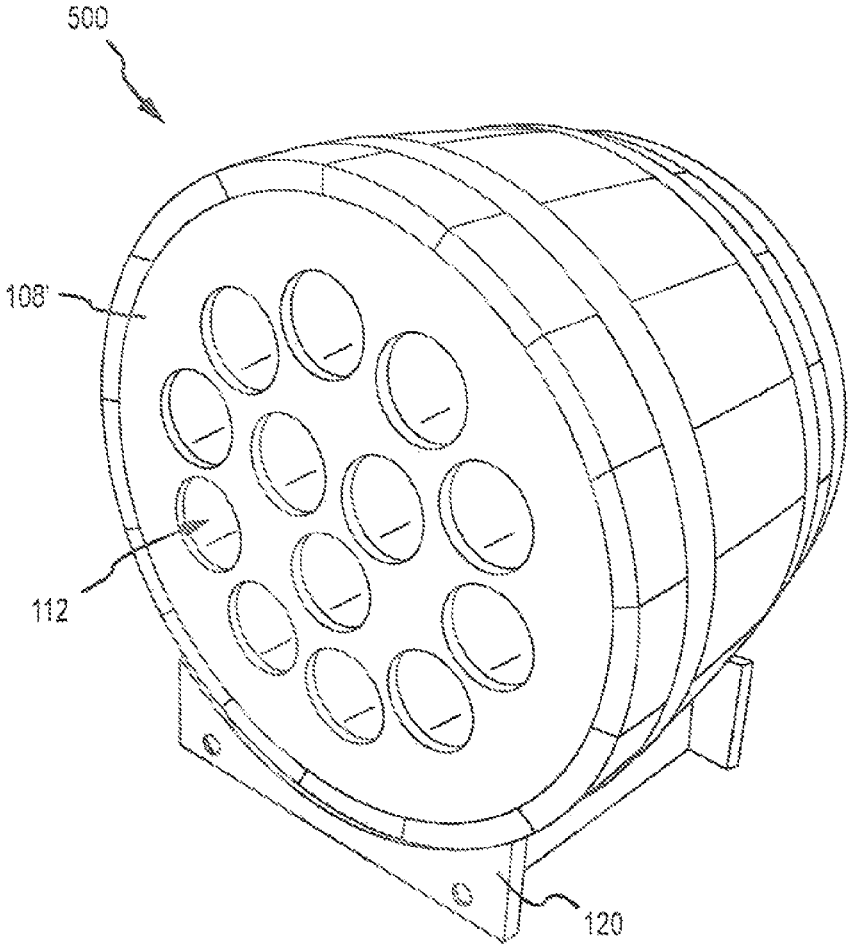
FIG. 7 depicts a perspective view of one embodiment of a half-barrel wine rack system and demonstrates one manner in which the wine rack system may be supported on an operating surface.
Figure 8:
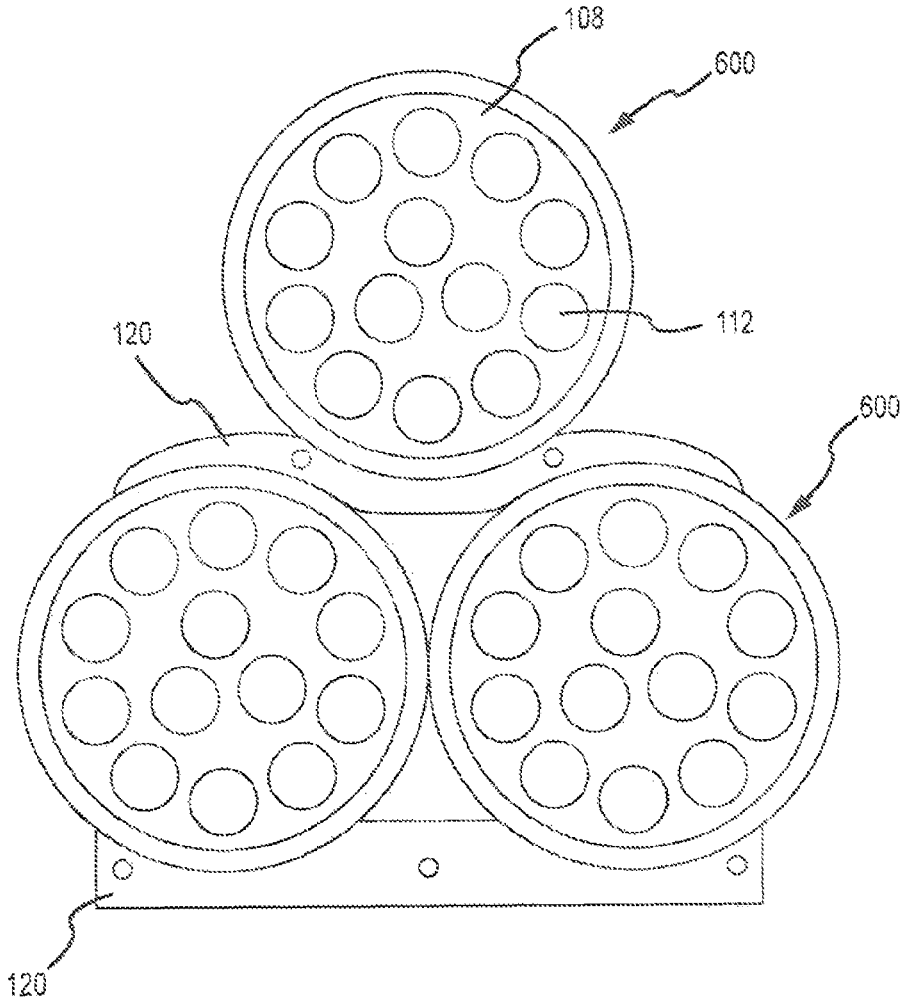
FIG. 8 depicts a front elevation view of another embodiment of the wine rack system and demonstrates another manner in which the wine rack system may incorporate a plurality of barrel units and be supported on an operating surface.
Figure 9:
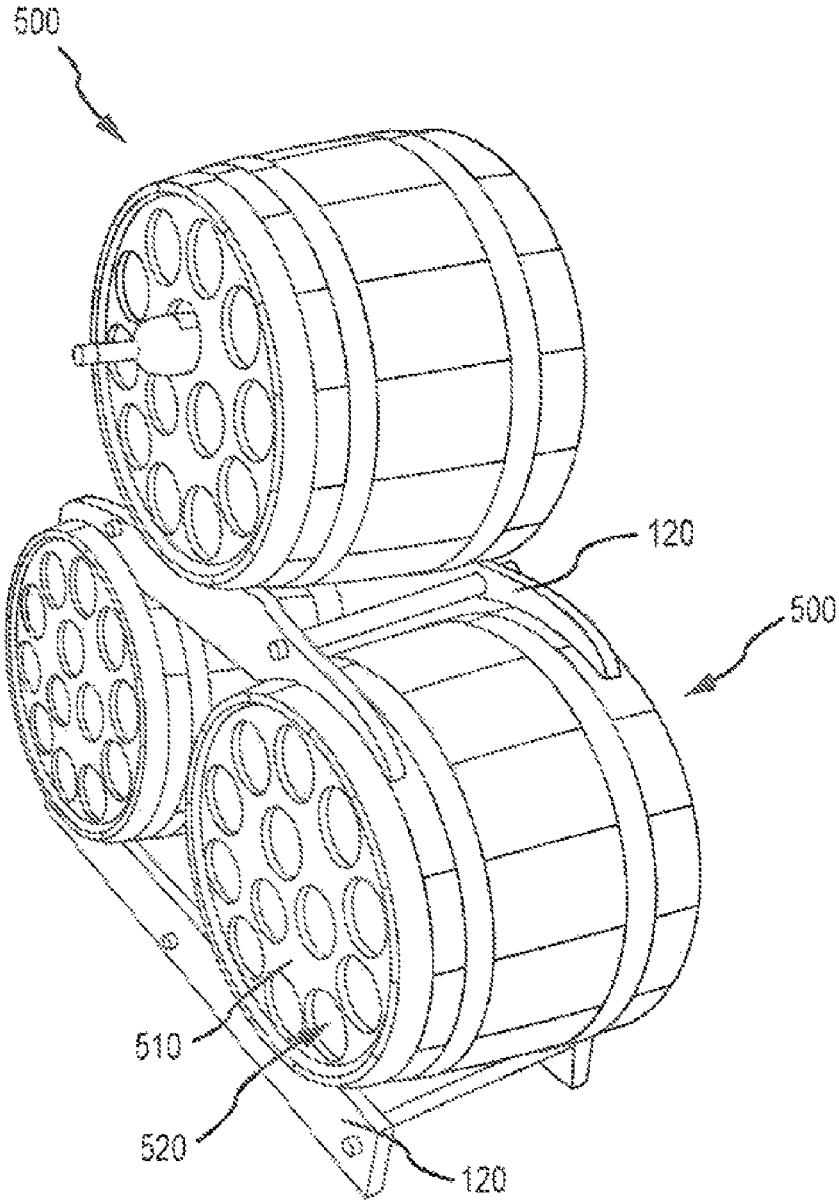
FIG. 9 depicts a perspective view of another embodiment of a half-barrel wine rack system and demonstrates one manner in which the wine rack system may incorporate a plurality of barrel units and be supported on an operating surface.
Figure 10:
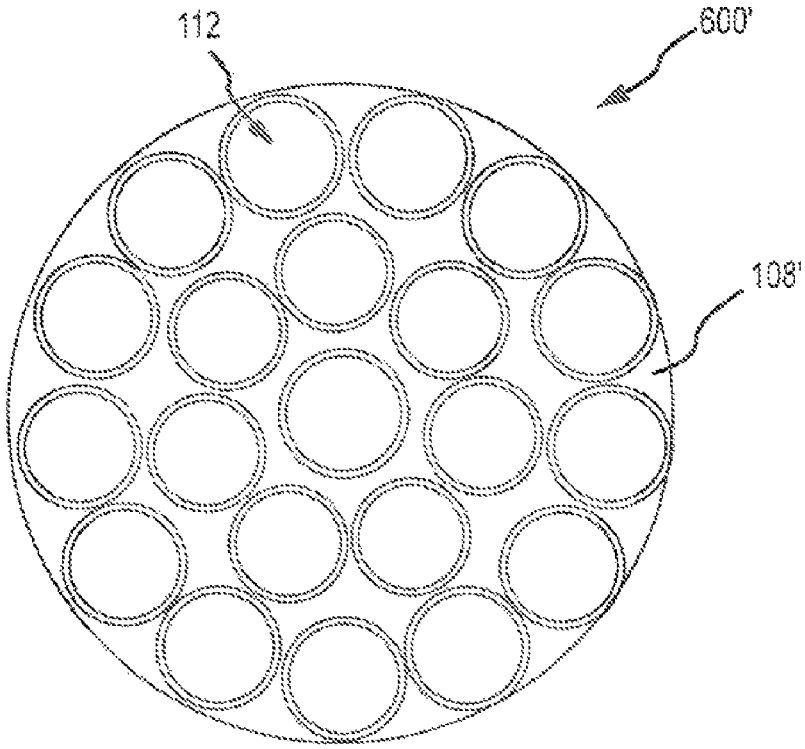
FIG. 10 depicts a front elevation view of one embodiment of a third-barrel wine rack system.
Figure 11:
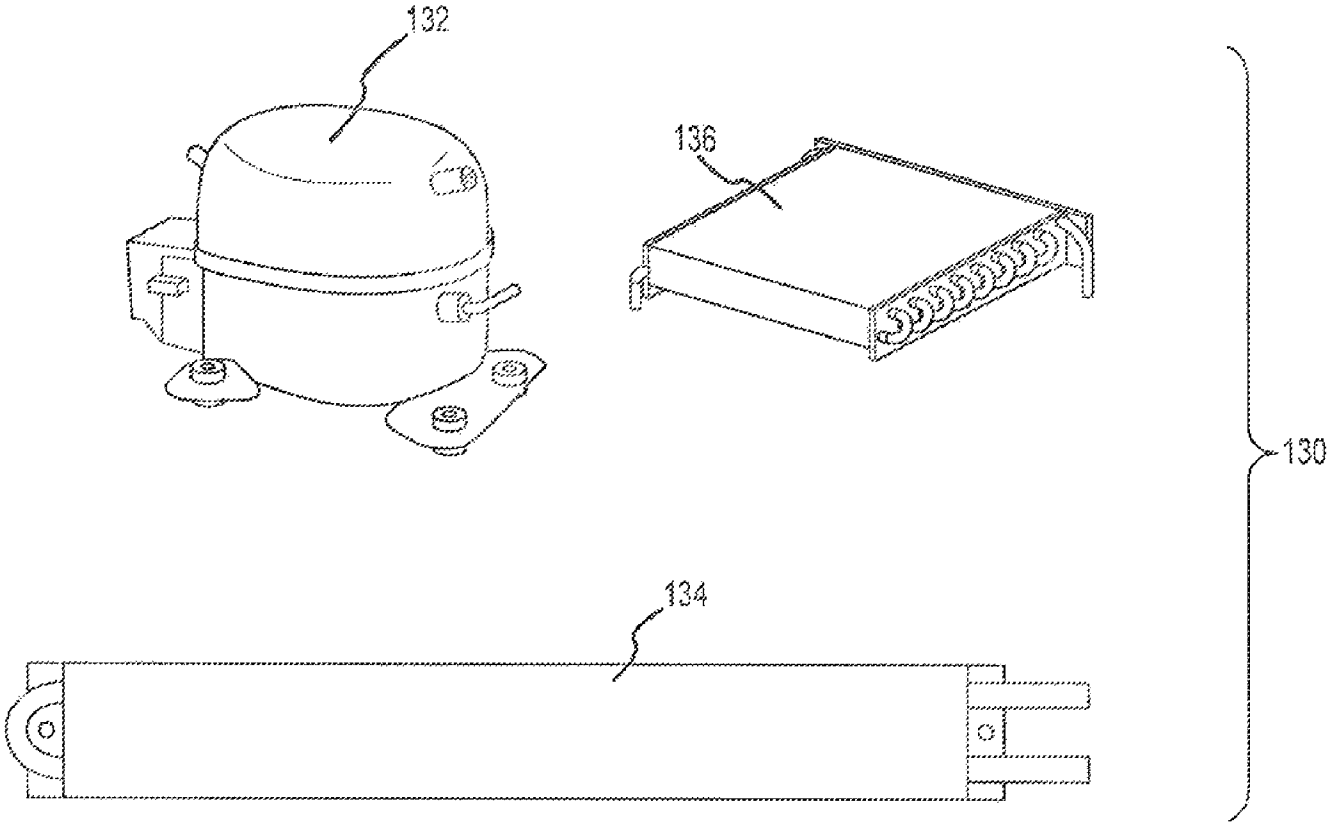
FIG. 11 depicts a partial system schematic of an environmental control system that may be made a part of various embodiments of the wine rack system.

With reference to FIGS. 7, 8 and 9, the use of certain types of barrel cradles 120 permits stacking of barrels one atop the other (i.e., in an "old-world" manner), such as an arrangement having a bottom row with two barrels and an upper row with two barrels. Cradles 120 are especially effective in resisting side-to-side motion or forward and backward rocking of barrels. Old-world stacking also can be achieved using barrel wedges 118. In some such embodiments, the wedges 118 may be secured to one or both barrels that are contacted by the wedges 118. Such an arrangement may promote long term stability of the wine rack system. Regardless of whether wedges or cradles 120 are chosen, the use of barrels of the similar size (and at times from the same barrel manufacturer) may provide a uniform appearance, secure fit of stacked barrels, and more consistent multiple-barrel arrangement.

In one method of forming a wine storage system, openings 112 can be cut in at least in the front head plate 108 (as located using a template or the like) of a barrel 102 while leaving the head plate(s) 108, 110 attached to the barrel. In addition, mounting holes for the support members 114 can be formed in the head plates 108, 110 at the same time. (In some embodiments, the support members 114 can be mounted to interior surfaces of the head plates 108, 110 using screws or other suitable mechanical fasteners that are inserted from outside the barrel 102.) Then, after forming the openings 112, the support members 114 can be inserted through the openings 112 and positioned for mounting to the head plates 108, 110 inside the barrel without having to remove the head plates. Alternatively, one or both head plates 108, 110 can be removed from their respective crozes 34, openings 112 and mounting holes formed in the head plates, and the head plates remounted in the crozes 34. If desired, when forming mounting holes for the support members in the head plates, the mounting holes can be counter-bored on the inside surfaces of the head plates to allow insertion of the ends of the support members (especially if cylindrical) into the counter-bores during mounting for additional structural integrity. As an alternative to mounting the support members 114 directly to the head plates, the support members can be mounted to a frame or the like (not shown) that is inserted in the barrel and aligned with the openings 112, followed by reattachment of the front head plate.

In various embodiments, the barrel 102 may be treated with a sealant, or the like, to enhance the wood finish and to stabilize moisture in the wood of the staves 104. Alternatively, the barrel 102 can be one (e.g., a "marketing demo" barrel) in which an adhesive has been applied between the staves; such a barrel looks exactly like a barrel intended to contain wine, but of course is not suitable for such use.

Figure 4:
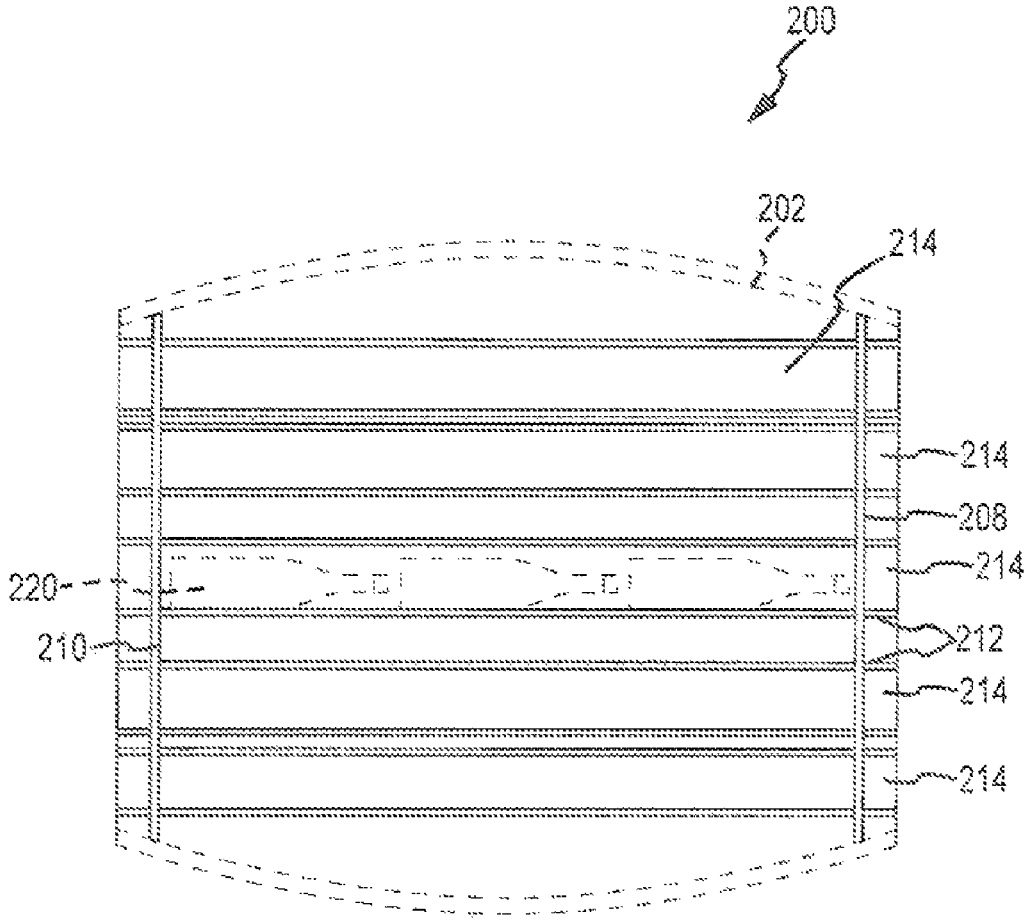
FIG. 4 depicts a cutaway side elevation view of one embodiment of the present wine rack system and demonstrates one manner in which the system may store bottles of wine.

In some embodiments, each support member may be, at least partially, tube-shaped. With reference to FIG. 4, tube-shaped support members 214 extend through the length of the barrel from the front head plate 208 to the rear head plate 210. If desired, the support members 214 can extend beyond the plane of the respective head plates, or at least beyond the plane of the front head plate 208.

In embodiments that employ tube-shaped support members, the support members 214 can be made from any of various materials such as stiff paper or cardboard, metal, wood, plastic, terra cotta, or the like. Each support member 214 has an exterior diameter that is sized to permit it to be mounted in the respective openings 112 in the head plates 208, 210 and an inner diameter that is sized to accommodate the exterior diameters of wine bottles that are to be stored. For example, a four-inch inside diameter is sufficient for substantially most 750-ML wine bottles, including champagne bottles. In some embodiments, the openings 112 have diameters just allowing the tubes 214 to be inserted through them. In at least one embodiment, the wall thickness of each tube 214 is 0.125 inch. Different materials may indicate different minimum wall thicknesses to ensure that the support members can support their intended loads for extended periods of time.

In other embodiments, the tube-like support members 214 do not extend through respective openings 112 in the rear head plate 210. Rather, a "hidden" support plate having a diameter slightly greater than the rear head plate 210 is inserted in the barrel 102 interiorly of and coaxial with the rear head plate 210. The support members 214 extend into or are otherwise supported by the support plate. In this manner, the rear of the barrel 102 is indistinguishable from a normal barrel. On the other hand, having the support members 214 extend through the rear head plate 210 allows access to wine bottles from both the front and the rear of the barrel 102. In some embodiments, the support members 214 are provided with ovular, triangular, square, or other polygonal cross-sections. Irrespective of cross-sectional shape, the width of each support member is sized to accommodate the wine bottles to be stored.

Figure 5A:
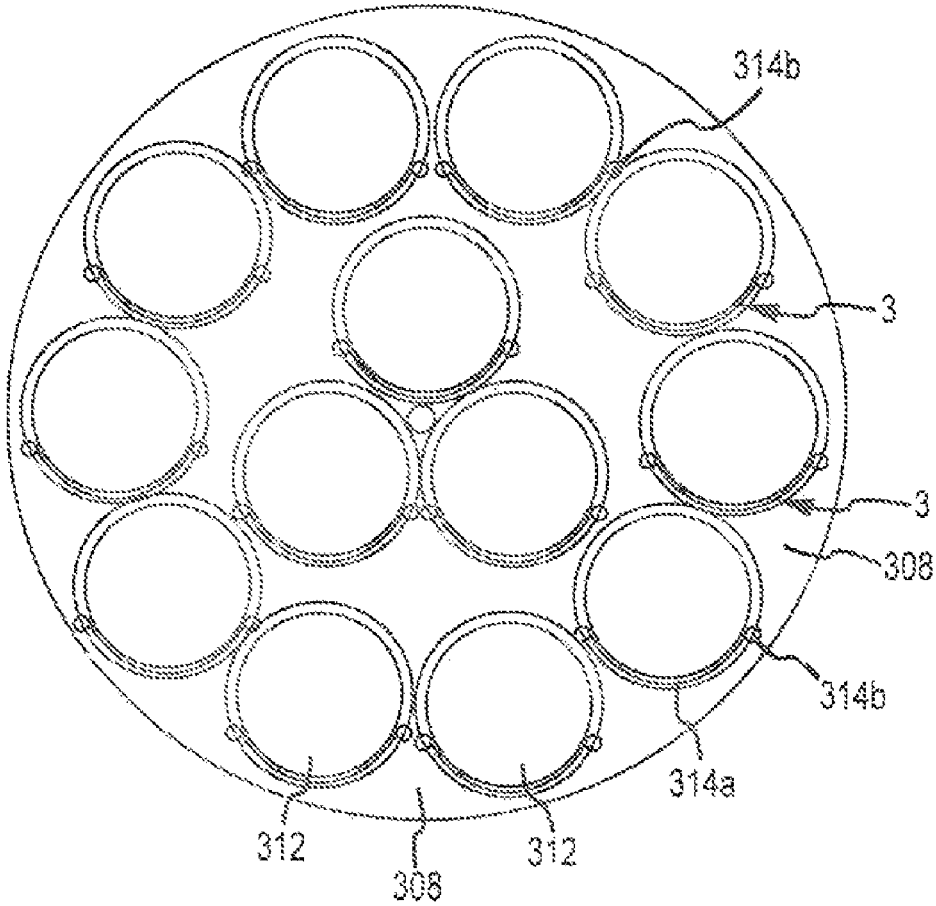
FIG. 5A depicts a front elevation view of one embodiment of a plurality of support members and one manner in which they may be coupled with at least one barrel head.
Figure 5B:
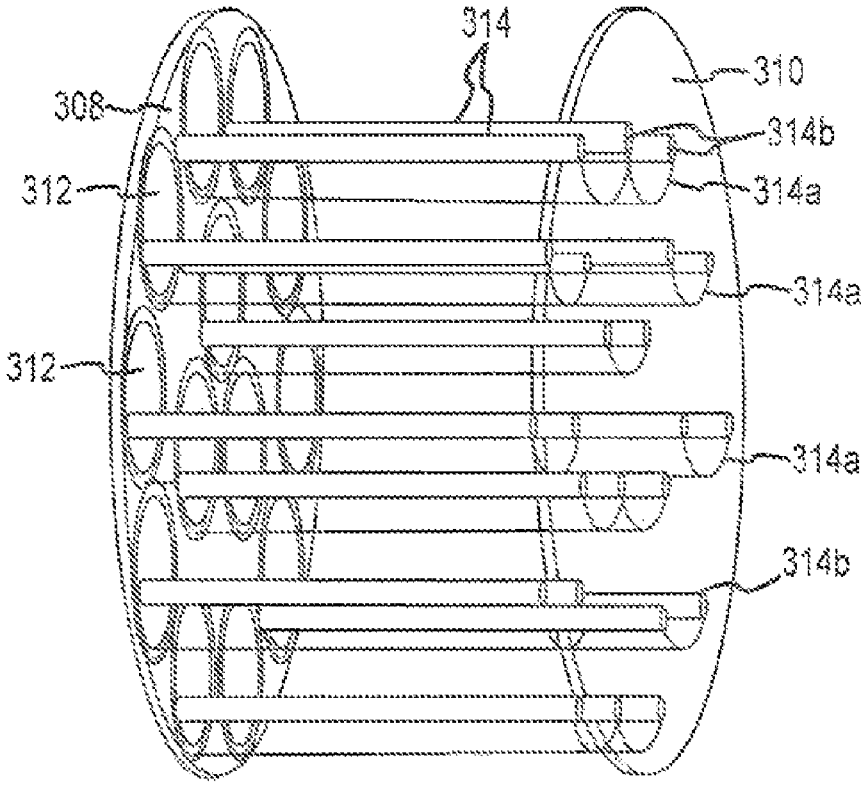
FIG. 5B depicts a side perspective view of the support members depicted in FIG. 5A.

With reference to FIGS. 5A and 5B, some embodiments of the wine rack system are provided with support members 314 that are configured as cradles. Each cradle support member 314 may be formed from a pair of parallel rods, dowels, or shafts 314*b* (similar to the support members 114) and an intermediary portion 314*a* that extends between the shafts 314*b* in a bottle-conforming manner. One advantage to this embodiment is that the support members 314 can support smaller bottles that might otherwise fall between the shafts 314*b* if the intermediary portions 314*a* were absent.

In various embodiments, the support members 314 may be attached directly to the front and rear head plates 108, 110, attached to the front head plate 108 and to a rear support plate 122, or attached to an internal frame 124 inserted into the barrel 102. In one embodiment, the internal frame 124 may include a front support plate 126 positioned within the barrel 102 behind the front head plate 108, a rear support plate 122 positioned within the barrel 102 in front of the rear head plate 110, and the shafts 314*b* that extend between the front and rear support plates 122, 126. With reference to FIG. 6C Such an internal frame could be aligned with openings 112 in the front head plate 108 of the barrel 102 using dowels 446 or other locating means such as pins. The front and rear hidden plates may then be mounted to interior surfaces of the front and rear head plates 108, 110 using screws or other appropriate fasteners. These fasteners can be configured, located, and applied so as not to be visible on the outside of the barrel.

The intermediary portions 314*a* of the support members 314 may be made of any suitable material and may be flexible or rigid. Examples include, but are not limited to, metal, fabric, plastic, netting, etc. If the support members 314 are made of a material such as plastic or metal, it is contemplated that the shafts and the sleeves may be integrally formed with one other.

Figure 6A:
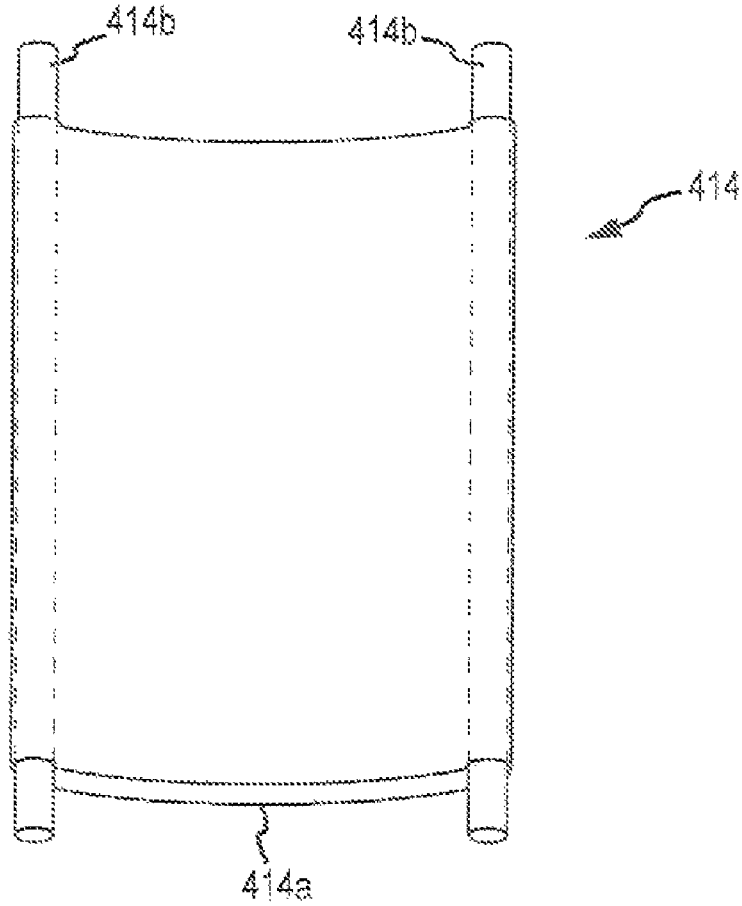
FIG. 6A depicts a top plan view of another embodiment of a support member that may be used with various embodiments of the present wine rack system.
Figure 6B:
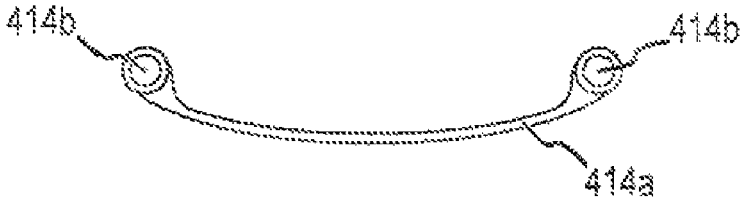
FIG. 6B depicts a front elevation view of one embodiment of the support member depicted in FIG. 6A.
Figure 6C:
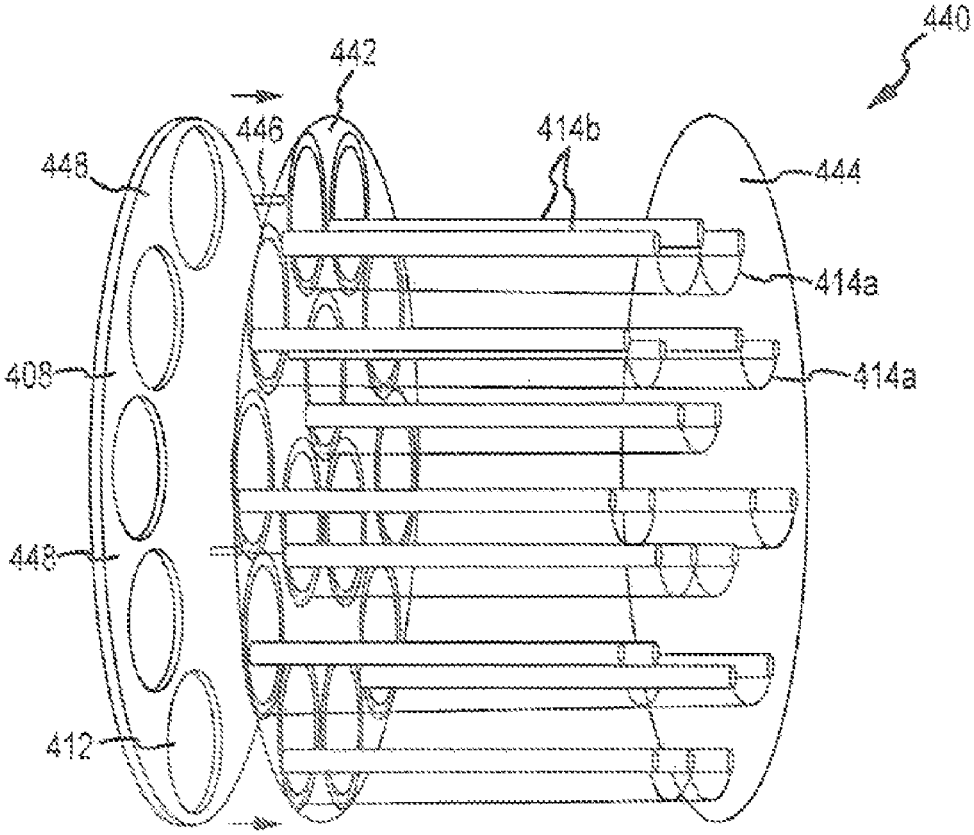
FIG. 6C depicts a side perspective view of a support panel that may be used with various embodiments of support members and head units of the present wine rack system.

With reference to FIGS. 6A and 6B, a sling 414 may be formed from a pair of parallel rods 414*b* and a sleeve 414*a*. In some embodiments, the sleeve 414*a* is provided as a continuous loop of material that defines an open interior through which the rods 414*b* may be passed. The rods 414*b* may then be laterally spaced from one another in a final mounting position that permits the sleeve 414*a* to hang between the rods 414*b*. The sleeve 414*a* is made of a flexible material such as metal or plastic screening, metal or plastic netting, fabric, metal sheet, reinforced rubber sheet, or the like, and desirably conforms to the rods and to a bottle being supported by it. The rods can be made of any suitable rigid material such as wood, metal, or plastic. The rods 414*b* and sleeve 414*a* extend the length of the barrel. The sleeve 414*a* naturally sags as shown, thereby facilitating its ability to conform to a bottle being held by it. In some embodiments, the rods 414*b* can be mounted to and extend inside the barrel 102 between the front and rear head plates, as described previously. In other embodiments, the rods can be mounted to internal plates (situated inwardly of the head plates) to form an internal frame.

With reference to FIG. 6C, one embodiment of an internal frame 440 may include a front internal support plate 442, a rear internal support plate 444, and interconnecting rods 414*b* that extend between the two support plates. The sleeves 414*a* may depend from the rods 414*b* as previously described. The internal frame 440 can be mounted inside the barrel to the interior surfaces of the front and rear head plates 108, 110 in the manner described previously. Alignment of the front internal plate 442 with the front head plate 408 and openings 412 can be facilitated by use of dowels 446, pins, or the like. The front internal plate 442 can be attached to the interior surface of the front head plate 108 of the barrel 102 using screws or other suitable mechanical fasteners. Similarly, the rear internal plate 444 can be attached to the interior surface of the rear head plate 110 of the barrel 102 using screws or other suitable mechanical fasteners.

Holes to receive the dowels 446 can be drilled through the thickness dimension of the internal plates 442, 444. However, corresponding holes 448 in the head plates desirably are drilled only partially through (from the interior surface) the head plates 408, 410 so that holes are not visible on external surfaces of the head plates. It will be understood that the number and placement of the dowels 446 can be selected depending upon the particular situation and structure. In some embodiments, the internal frame 440 may be made slightly undersized in length to accommodate barrel-manufacturing variations. In such instances, the alignment dowels 446, or the like, can be made correspondingly longer to accommodate the variations as well as allow for expansion/contraction of the wine barrel and internal structure.

In some embodiments, a wine rack 500 may be constructed using half of a barrel 102. Where existing barrels 102 are used in such embodiments, the barrels 102 are cut along an approximate midpoint of the barrel 102, through the bilge 14, along a line that is transverse with a long axis of the barrel 102. It is contemplated, however, that such wine racks may be made from new materials, without modifying an existing barrel 102. In some embodiments, depending on the type of barrels 102 used, the wine rack 500 will measure approximately 17" deep and may hold two wine bottles per support member 114 where the rear head plate 510 is provided with openings 520 and a small portion of each wine bottle is allowed to protrude from either the back or the front of the wine rack 500. Irrespective of whether the wine rack 500 is constructed from half an existing or a newly constructed barrel 102, a new head plate 108' will need to be constructed to fill the opening presented near the bilge 14 of the barrel 102 due to the fact that an original head plate 108 will not adequately fill the opening. The new head plate 108' will be similar in design to the head plate 108, may be constructed of nearly any desirable material, and formed as a solid disk or with openings 112 that penetrate the head plate 108' to align with one or more support members 114 within the barrel 102. In certain embodiments, the wine racks 500 will be less expensive to fabricate than wine racks using a full barrel 102 due to the reduction in materials used. The wine rack 500 also provides the benefit of being used in areas with limited space, where a full-sized barrel 102 would not fit or would not be desirable.

In other embodiments, a wine rack 600 may be constructed using a third of a barrel 102. The wine rack 600 may be fabricated using new materials or from an existing barrel 102 by cutting one third of the barrel 102 from the remainder of the barrel 102 along a line that is transverse with a long axis of the barrel 102. In some embodiments, depending on the type of barrels 102 used, the wine rack 600 will measure approximately 12" deep and will generally hold one wine bottle per support member 114. Where both end thirds of the barrel 102 are severed from the barrel 102, a middle third, which includes the bilge 14, remains. This middle third may be used to form a uniquely shaped wine rack 600' that resembles a full-sized barrel 102 that has been compacted along its long axis. When fabricating a wine rack 600 from an existing barrel 102, an additional set of barrel hoop bands may be applied to the barrel 102, adjacent either side of the bilge 14, prior to the cutting the barrel 102. The additional hoop bands hold the middle section together where no hoop bands previously existed. As with the wine rack 500 one or more head plates 108', as previously described, will need to be fabricated to occupy the opening created adjacent the bilge 14 of the barrel 102. One new head plate 108' will suffice in many embodiments where an end third of the barrel 102 is used whereas two head plates 108' may need to be fabricated where a middle third is used.

One advantage to using the middle section is that the middle third of the barrel 102 has a greater diameter than the end thirds. Accordingly, a greater number of support members 114 may be positioned in a middle third of the wine barrel 102. In some embodiments, the end portions on a middle third of an average wine barrel 102 may have an opening that measures approximately 24". This is an increase of approximately 5.5" or about fifty percent more surface area than the openings at the heads of the barrel 102. In some embodiments, the increased dimensions will accommodate twenty-one support members 114, as opposed to the thirteen support members generally available within a wine rack 600 formed from an end third of the barrel 102.

Figure 12:
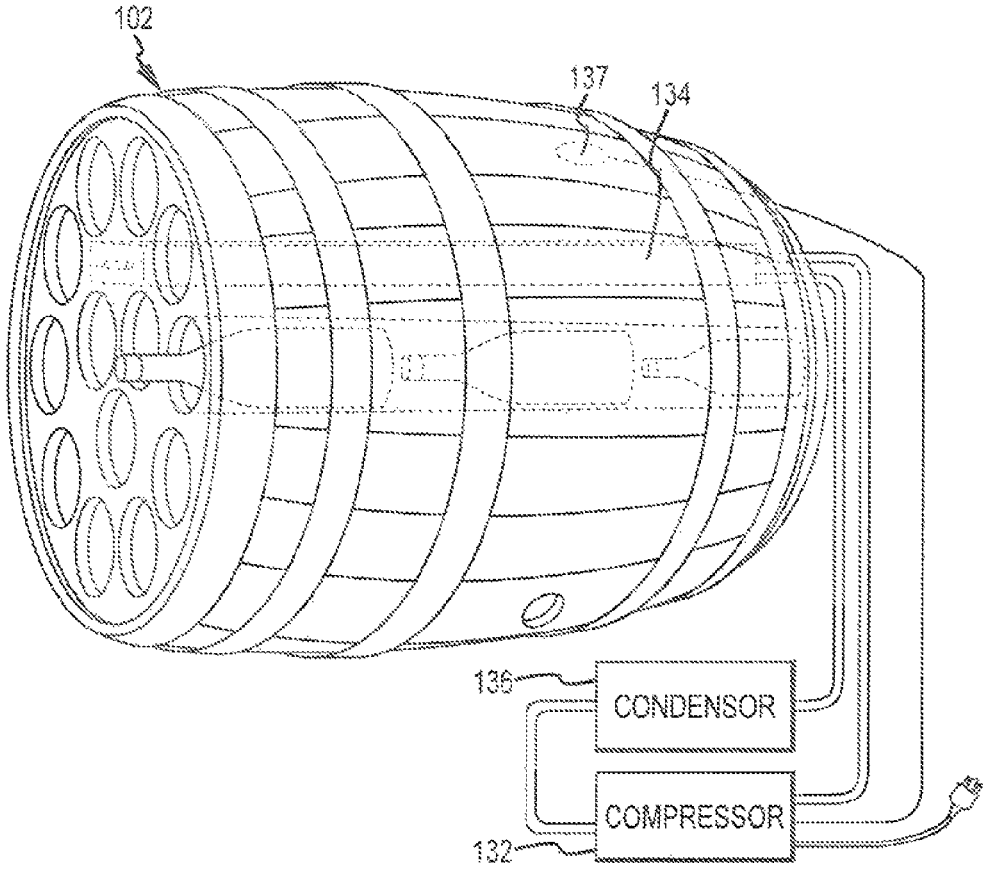
FIG. 12 depicts a perspective view of one embodiment of an environmental control system and one manner in which the environmental control system may be incorporated with at least one embodiment of the wine rack system.
Figure 13:
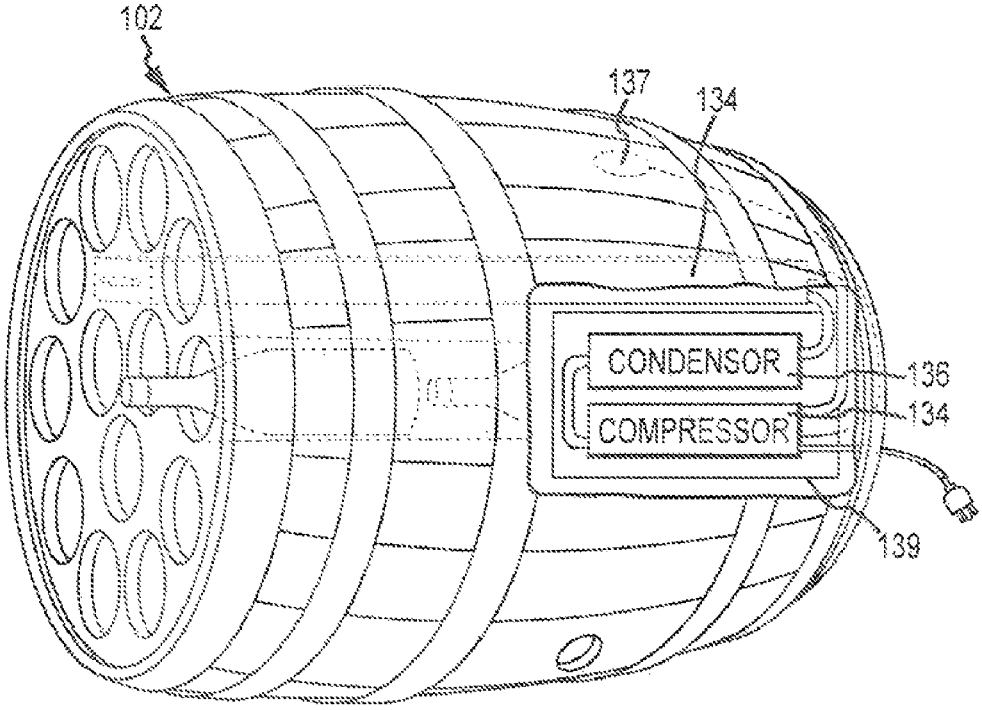
FIG. 13 depicts a perspective view of another embodiment of an environmental control system and at least one manner in which the environmental control system may be incorporated with at least one embodiment of the wine rack system.

Various embodiments of the wine racks may incorporate the use of one or more environmental controls. In particular, the wine racks may include a cooling system 130. A variety of cooling systems may be used. In some embodiments, a conventional "vapor phase" system used in many styles of refrigerators may provide a low-cost method of cooling the barrels 102. Various vapor-phase coolers that may be used with the present wine rack systems include a compressor 132, evaporator 134, and condenser 136. Various embodiments may further include a controller 137 to cycle the temperature in a relatively tight range, such as a two degree variance in some embodiments. Such a controller 137 may further permit a user to define a temperature setting within the barrel 102 of between 45° F. to 60° F. In at least one embodiment, the cooling system 130 includes a compressor 132, such as the EM30HHR available from Embraco Corp., which is capable of producing approximately 500 BTU. In many embodiments, an evaporator 134 of common design in the cooling arts may be placed inside the barrel 102 to cool the interior of the barrel 102. Various embodiments of the wine rack system will position the evaporator 134 at the top of the interior of the barrel 102, between the top support members 114, and runs nearly the full length of the barrel 102. This positioning allows for an efficient heat transfer within the barrel 102. A condenser 136 of common design in the cooling arts may be placed outside the wine rack. With reference to FIG. 12, some embodiments of the cooling system 130 may position the compressor 132 and condenser 136 externally, beneath the barrel 102 to conceal them from view. Some embodiments may use ventilation louvers adjacent the condenser 136 where, for example, the condenser 136 is enclosed in a base or other support structure. In other embodiments, a fan may be provided adjacent the condenser 136. With reference to FIG. 13, some embodiments of the cooling system 130 may be provided so that the compressor 132 and condenser 136 are positioned within the barrel 102. In some such embodiments, one or more support members 114 may be provided to stop short of the rear head plate 110 to provide a void near a rear end portion of the barrel 102 in which the compressor and condenser 136 may reside in such embodiments, the shortened support members 114 may only have a length that accommodates two wine bottles in a full barrel-style wine rack. In this embodiment, the void that houses the components may be sealed-off from the rest of the interior of the barrel 102 with an enclosure 139. One or more fans may also be associated with the void to expel heated air from the interior of the barrel 102.

In those embodiments that use a cooling system 130, insulation may be an issue. However, adequate insulation is typically afforded where the barrel 102 is formed from ¾" wooden staves. It is contemplated, however, that additional layers of insulation could be provided to the interior walls of the barrel 102 where additional insulating properties are desired. Such additional insulation may be comprised of many known materials suitable for insulating refrigerated structures. In embodiments where cardboard tubes are used to provide the support members 114 adequate heat transfer will occur with the bottles. In some embodiments where the wine racks are used in humid environments, the cardboard tubes may be treated with a water-resistant coating to prevent water absorption. Alternately, the cardboard tubes may be replaced with tubes of a water resistant material, such as metal or plastic.

In various climate controlled embodiments, the rearward and forward ends of the support members may be covered to prevent heat gain in the stored bottles. In some embodiments, the rearward portions of the support members 114 may be closed by simply not forming openings 112 through the rear head plate 110. In other embodiments, the rearward and forward portions of the support members 114 be covered with a removable cover to allow for easy bottle access. It is contemplated that the covers may be provided as an overall cover for the entire barrel head, or individual covers that are removably or hingedly connected adjacent the ends of the support members 114. It is contemplated that in at least some embodiments, the covers could be provided to be relatively planar "doors" of various peripheral shapes. In other embodiments, the covers could be shaped to have a convex interior that at least partially accommodates a potion of a wine bottle that protrudes from an opening 112 in a front head plate 108 or a rear head plate 110.

Figure 14:
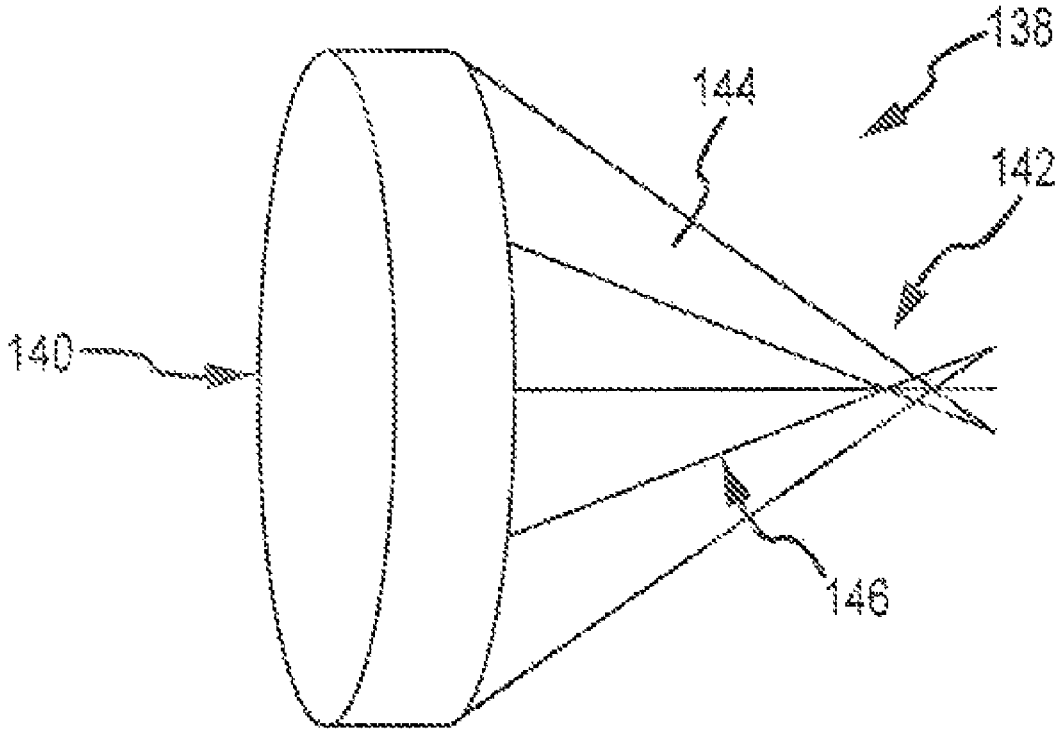
FIG. 14 depicts a side elevation view of one embodiment of a pass-through cover that may be made a part of various embodiments of the wine rack system.

With reference to FIG. 14, one embodiment of such a cover may be provided as a generally conically shaped, pass-through cover 138 having an open first end portion 140 and a second end portion 142 that may be selectively moved between open and closed positions. In some embodiments, the first end portion 140 is removably or permanently coupled with a wine rack adjacent an opening 112 in a front head plate 108 or a rear head plate 110, using an adhesive, such as glue or one of a wide array of known mechanical fasteners. In other embodiments, the pass-thorough cover 138 is press-fit within an opening 112. In various embodiments, the second end portion 142 of the pass-thorough cover 138 will be defined by a plurality of elongated, flexible fingers 144, whereby distal lend portions of the fingers 144 are biased toward one another to automatically close an opening in the send end portion 142. Accordingly, the fingers 144 may be manually pried open to permit insertion or removal a bottle through the opening in the second end 142. Various embodiments of the pass-through cover 138 may provide the fingers 144 by forming a series of one or more radial "slits" 146 in the flexible material. In still other embodiments, the fingers 144 may be defined by pleated sections of material that permit the conical or peaked second end portion 142 to be mechanically expanded to an open position. In some embodiments, bottles may be positioned to permit a portion of a bottle, such as a neck, to extend through the opening in the second end portion 142, while the fingers 144 engage the exterior of the bottle to limit heat transfer between the interior of the barrel 102 and an exterior environment. The pass-through cover 138 may be formed from a wide array of materials, such as plastics, various forms of paper-based products such as cardboard, and the like. In some embodiments the materials selected may be generally transparent to permit users to easily see into the barrel 102.

Figure 15:
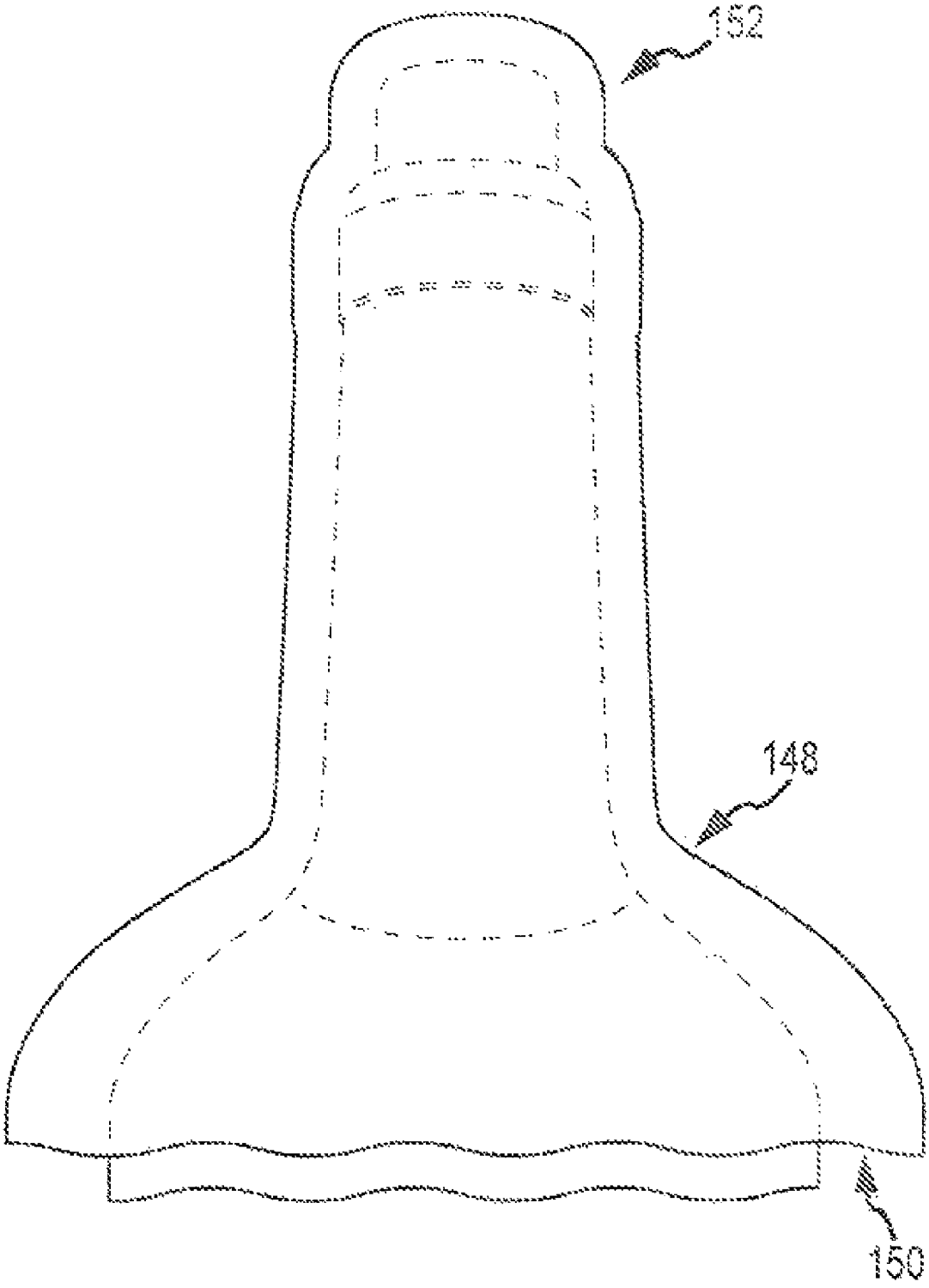
FIG. 15 depicts a side elevation view of one embodiment of a closed cover that may be made a part of various embodiments of the wine rack system.

With reference to FIG. 15, another embodiment of a cover may be provided as a closed cover 148, having an open first end portion 150 and a closed second end portion 152. In some embodiments, the closed cover 148 may be provided with an exterior shape that closely resembles the shape of an upper portion of a wine bottle. An interior of the closed cover 148 may be similarly shaped and sized to accommodate at least a top end portion of a wine bottle. In this manner, the closed cover may be removably coupled with the wine rack adjacent an opening 112 so that the opening 112 may be closed and a portion of a wine bottle positioned within the closed cover 148. In some embodiments, a deformably resilient material may be positioned around a an exterior peripheral edge of the open second end 150 of the closed cover 148 to create a soft seal and frictional engagement with the wine rack, adjacent an opening 112. The closed cover may be constructed of a wide array of transparent or translucent materials that may be clear or colored according to the desired use and visual effect.

Although the wine racks have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth). Expressions such as "up," "down," "upper," "lower," "horizontal," "vertical," "left," "right," and the like are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object.

What is claimed is:

1. A rack for bottles, comprising:

at least a portion of a barrel including (i) a generally annular sidewall that extends front to rear and defines an interior space inside the barrel that extends between a front opening and a rear opening, (ii) a front head plate that at least partially encloses the front opening, and (iii) a rearward head plate that at least partially encloses the rear opening;

at least one of the head plates defining multiple head plate openings that penetrate the at least one head plate; and at least some of the head plate openings being associated with a plurality of support members that extend from the head plate openings lengthwise through the interior of the barrel toward a rear portion of the barrel; the plurality of support members being positioned with respect to the barrel to receive and hold at least one wine bottle.

2. The rack of claim 1, wherein the head plate openings are round.

3. The rack of claim 1, wherein each support member comprises a respective pair of laterally spaced apart, parallel shafts.

4. A rack for bottles, comprising:

at least a portion of a barrel including (i) a generally annular sidewall that extends front to rear and defines an interior space inside the barrel that extends between a front opening and a rear opening, (ii) a front head plate that at least partially encloses the front opening, and (iii) a rearward head plate that at least partially encloses the rear opening;

at least one of the head plates defining, multiple head plate openings that penetrate the at least one head plate; and at least some of the head plate openings being associated with a plurality of support members that extend from the head plate openings lengthwise through the interior of the barrel toward a rear portion of the barrel; the plurality of support members being positioned with respect to the barrel to receive and hold at least one wine bottle; each support member further including a respective pair of laterally spaced apart, parallel shafts and a rigid cradle that extends between the shafts.

5. A rack for bottles, comprising:

at least a portion of a barrel including a generally annular sidewall that extends front to rear and defines an interior space inside the barrel that extends between a front opening and a rear opening, (ii) a front head plate that at least partially encloses the front opening, and (iii) a rearward head plate that at least partially encloses the rear opening;

at least one of the head plates defining multiple head plate openings that penetrate the at least one head plate; and at least some of the head plate openings being associated with a plurality of support members that extend from the head plate openings lengthwise through the interior of the hand toward a rear portion of the barrel; the plurality of support members being positioned with respect to the barrel to receive and hold at least one wine bottle; each support member further including a respective pair of laterally spaced apart shafts and a flexible sling that extends lengthwise along the shafts and depends from between the shafts.

6. The rack of claim 1, wherein each support member is comprised of a tube.

7. The rack of claim 1 further comprising a cooling system associated with the interior of the barrel.

8. The rack of claim 1, wherein:

both the front head plate and the rear head plate define a plurality of head plate openings that penetate the front head plate and rear head plate; at least some of the head plate openings in the front head plate being coaxially positioned with openings in the rear head plate; and the support members extending longitudinally inside the barrel between the head plate openings in the front head plate to the head plate openings in the rear head plate.

9. The rack of claim 1 wherein opposite end portions of the support members are coupled with interior surfaces of the front head plate and rear head plates.

10. The rack of claim 1 wherein opposite end portions of the support members are attached to an internal frame positioned inside the barrel and aligned with at least some of the head plate openings formed in the front head plate.

11. The rack of claim 10, wherein the internal frame comprises front and rear support plates to which opposite end portions of the support members are coupled, whereby the support members extend between the front and rear support plates lengthwise in the barrel from the front portion of the barrel to the rear portion of the barrel.

12. The rack of claim 1, wherein the barrel is provided to resemble a half portion of a barrel.

13. The rack of claim 1 wherein the barrel is provided to resemble a one-third portion of a barrel.

14. A wine-rack system, comprising:

a plurality of barrel units, each barrel unit comprising at least a portion of a barrel and including a front head plate; a rear head plate; and staves arranged around each head plate and extending front to rear, the staves being held together around the head plates and longitudinally to each other to define an interior space inside the barrel;

at least the front head plate of each barrel unit defining multiple head plate openings that penetrate the head plate;

each head plate opening having associated therewith a support member that extends from the openings lengthwise through the interior of the barrel toward a rear portion of the barrel; the support members being positioned with respect to the barrel to receive and hold at least one wine bottle; and at least one barrel-holding device securing the plurality of barrel units in position with respect to one another.

15. The system of claim 14, wherein the at least one barrel-holding device is comprised of a barrel cradle.

16. The system of claim 15, wherein the plurality of barrel units are stacked vertically with respect to one another.

17. The system of claim 14, wherein the at least one barrel-holding device is comprised of a plurality of barrel wedges that are positioned between barrel units and arranged so that the plurality of barrel units are stacked vertically with respect to one another.

18. The system of claim 14, wherein the barrel units are provided as half barrels.

19. A method for storing wine bottles, comprising:

with respect to a barrel unit having: (i) a generally annular sidewall that extends front to rear and defines an interior space inside the barrel that extends between a front opening and a rear opening, (ii) a front had plate that at least partially encloses the front opening, and (iii) a rearward head plate that at least partially encloses the rear opening; providing at least one of the head plates with multiple head plate openings penetrating the head plate;

inside the barrel unit, providing each head plate opening with a corresponding support member that extends from the head plate opening lengthwise through the interior of the barrel toward a rear portion of the barrel;

passing at least one wine bottle through one of the head plate openings into the interior space of the barrel unit; and positioning the at least one wine bottle on one of the support members in a generally horizontal storage position.

20. The method of claim 19 further comprising:

shaping the barrel unit to resemble a half portion of it barrel;

passing at least two wine bottles through a single one of said head plate openings into the interior space of the barrel unit; and positioning the at least two wine bottles on one of the support members in generally horizontal storage positions.

21. The method of claim 19, further comprising:

shaping the barrel unit to resemble a one-third portion of a barrel;

passing at least one wine bottle through a single one of said head plate openings into the interior space of the barrel unit; and positioning the at least one wine bottle on one of the support members in a generally horizontal storage position.

22. The method of claim 19 wherein at least three wine bottles are passed through a single one of said head plate openings into the interior space the barrel unit and the at least three wine bottles are positioned on one of the support members in generally horizontal storage positions.

23. The method of claim 19, further providing the barrel unit with a cooling system that reduces and maintains a temperature within the interior space of the barrel unit.

* * * * *